US011292267B2

(12) United States Patent
Suyama et al.

(10) Patent No.: US 11,292,267 B2
(45) Date of Patent: Apr. 5, 2022

(54) PRINTING APPARATUS AND AN INK CIRCULATION METHOD

(71) Applicant: SCREEN HOLDINGS CO., LTD., Kyoto (JP)

(72) Inventors: Tadayoshi Suyama, Kyoto (JP); Koji Furuichi, Kyoto (JP)

(73) Assignee: SCREEN HOLDINGS CO., LTD., Kyoto (JP)

( * ) Notice: Subject to any disclaimer, the term of this patent is extended or adjusted under 35 U.S.C. 154(b) by 0 days.

(21) Appl. No.: 17/017,233

(22) Filed: Sep. 10, 2020

(65) Prior Publication Data

US 2021/0086521 A1 Mar. 25, 2021

(30) Foreign Application Priority Data

Sep. 19, 2019 (JP) ..... JP2019-170122

(51) Int. Cl.
*B41J 2/18* (2006.01)
*B41J 2/175* (2006.01)

(52) U.S. Cl.
CPC ..... *B41J 2/18* (2013.01); *B41J 2/175* (2013.01)

(58) Field of Classification Search
CPC ..... B41J 2/18; B41J 2/175; B41J 2/165; B41J 2/19; B41J 29/38; B41J 2/17563
See application file for complete search history.

(56) References Cited

U.S. PATENT DOCUMENTS

| | | | |
|---|---|---|---|
| 8,262,209 | B2 | 9/2012 | Nitta et al. |
| 2011/0316904 | A1 | 12/2011 | Isozaki et al. |
| 2017/0197417 | A1 | 7/2017 | Karita et al. |
| 2018/0370245 | A1 | 12/2018 | Moriwaki |

FOREIGN PATENT DOCUMENTS

| | | | |
|---|---|---|---|
| EP | 2 977 210 | A1 | 1/2016 |
| JP | 2011-255580 | A | 12/2011 |
| WO | 2006/064040 | A1 | 6/2006 |
| WO | 2006/075314 | A2 | 7/2006 |

OTHER PUBLICATIONS

Extended European Search Report issued in corresponding European Patent Application No. 20194955.9-1017, dated Jan. 18, 2021.

*Primary Examiner* — An H Do
(74) *Attorney, Agent, or Firm* — McDermott Will & Emery LLP

(57) ABSTRACT

The ink I is circulated along the circulation channel We at the low-speed flow rate Vl lower than that during the execution of the print mode when the print mode is stopped (Steps S107, S110). By circulatingly supplying the ink I to the discharge heads H in this way, the deterioration of the ink I can be also suppressed while the drying of the ink I is suppressed.

8 Claims, 9 Drawing Sheets

FIG. 9

| | CIRCULATION FLOW RATE | HEATING | CAPPING |
|---|---|---|---|
| START-UP MODE | Vo(NORMAL CIRCULATION) | ON | ON |
| PRINT MODE | Vo(NORMAL CIRCULATION) | ON | OFF |
| NON-HEATING STOP MODE | Vl(LOW-SPEED CIRCULATION) | OFF | ON |
| HEATING STOP MODE | Vl(LOW-SPEED CIRCULATION) | ON | USER SELECTION |

PRINTING APPARATUS AND AN INK CIRCULATION METHOD

CROSS REFERENCE TO RELATED APPLICATION

The disclosure of Japanese Patent Application No. 2019-170122 filed on Sep. 19, 2019 including specification, drawings and claims is incorporated herein by reference in its entirety.

BACKGROUND OF THE INVENTION

1. Field of the Invention

This invention relates to a technique for circulatingly supplying an ink to a discharge head which discharges the ink from a nozzle.

2. Description of the Related Art

Conventionally, a printing apparatus is known which prints an image by discharging an ink from a nozzle of a discharge head by an inkjet method. In printing using the discharge head in this way, if the ink stays in the discharge head for a long time, the ink may be dried and solidified to clog the nozzle of the discharge head. Accordingly, a printing apparatus described in JP 2011-255580A prints an image by circulatingly supplying an ink to a discharge head and discharging the supplied ink from a nozzle of the discharge head.

SUMMARY OF THE INVENTION

Since the ink is dried not only when printing is performed, but also while printing is stopped, the ink needs to be circulated also when printing is stopped. However, the ink may be deteriorated by a load applied thereto according to circulation. Such deterioration of the ink tends to be more accelerated as a circulating flow rate of the ink increases.

This invention was developed in view of the above problem and aims to provide a technique capable of suppressing the deterioration of an ink while suppressing the drying of the ink by circulatingly supplying the ink to a discharge head.

A printing apparatus according to the invention, comprises: a discharge head which discharges an ink from a nozzle; an ink feeding unit which selectively performs normal circulation of supplying the ink to the discharge head by circulating the ink along a circulation channel starting from the discharge head and returning to the discharge head and low-speed circulation of circulating the ink along the circulation channel at a flow rate lower than that in the normal circulation; and a control unit which performs a print mode of printing an image by causing the discharge head to discharge the ink from the nozzle while causing the ink feeding unit to perform the normal circulation and causes the ink feeding unit to perform the low-speed circulation when the print mode is stopped.

An ink circulation method according to the invention, comprises: performing a print mode of printing an image by discharging an ink from a nozzle of a discharge head while performing normal circulation of circulating the ink along a circulation channel starting from the discharge head and returning to the discharge head; and performing low-speed circulation of circulating the ink along the circulation channel at a flow rate lower than that in the normal circulation when the print mode is stopped.

In the invention (printing apparatus, ink circulation method) thus configured, the ink is circulated along the circulation channel at the flow rate lower than that during the execution of the print mode when the print mode is stopped. By circulatingly supplying the ink to the discharge head in this way, the deterioration of the ink can be also suppressed while the drying of the ink is suppressed.

As described above, according to the invention, the deterioration of an ink can be also suppressed while the drying of the ink is suppressed by circulatingly supplying the ink to a discharge head.

The above and further objects and novel features of the invention will more fully appear from the following detailed description when the same is read in connection with the accompanying drawing. It is to be expressly understood, however, that the drawing is for purpose of illustration only and is not intended as a definition of the limits of the invention.

BRIEF DESCRIPTION OF THE DRAWINGS

FIG. 9 is a table showing contents set in the mode control of FIG. 8.

DETAILED DESCRIPTION OF THE PREFERRED EMBODIMENTS

Figure 1:
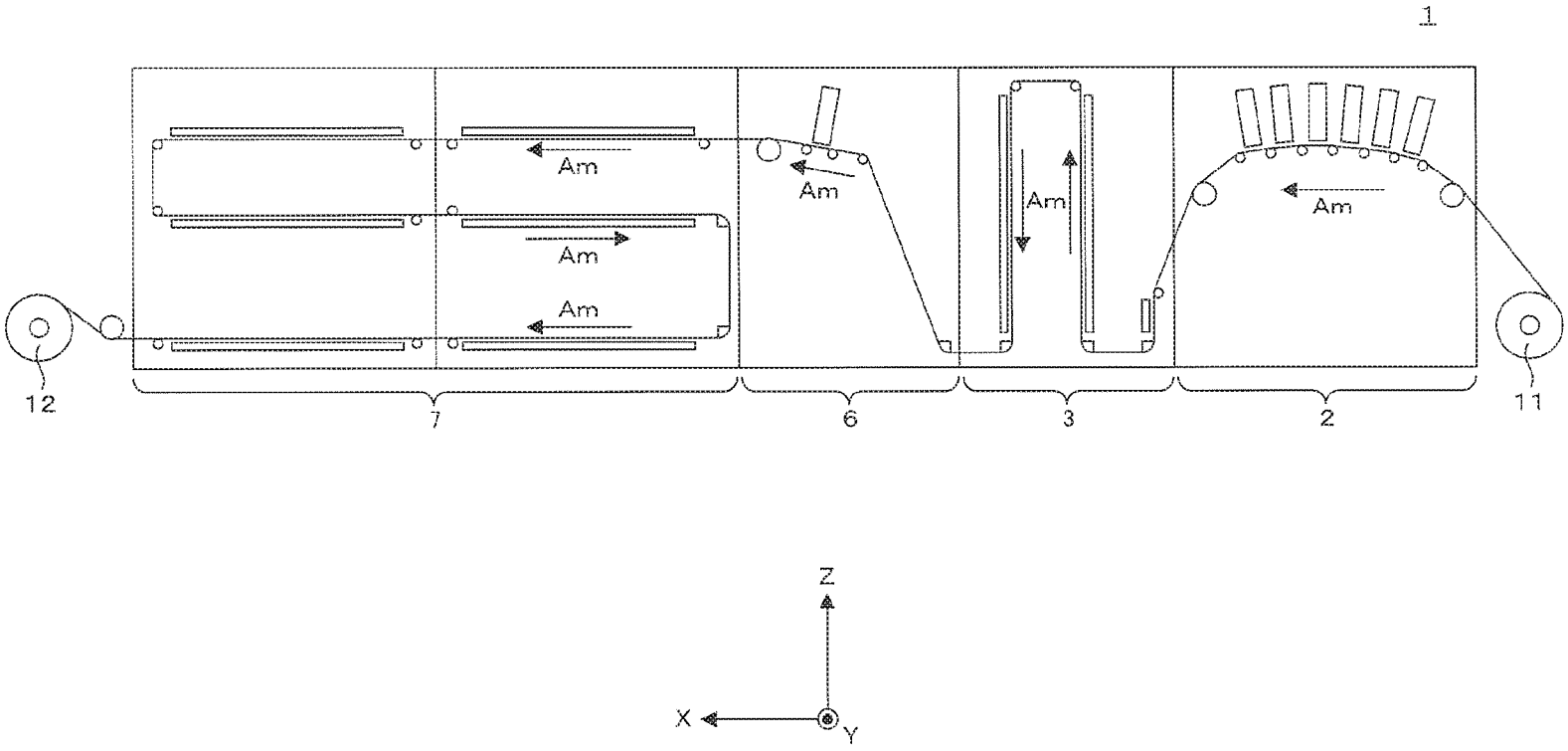
FIG. 1 is a front view schematically showing a printing system with printing apparatuses according to the invention.

FIG. 1 is a front view schematically showing a printing system with printing apparatuses according to the invention. In FIG. 1 and subsequent figures, an X direction, a Y direction and a Z direction orthogonal to each other are shown as appropriate. Here, the X direction and the Y direction are respectively horizontal directions and the Z direction is a vertical direction. As shown in FIG. 1, the printing system 1 comprises a pre-stage printing apparatus 2, a pre-stage drier 3, a post-stage printing apparatus 6 and a post-stage drier 7 which have the same height and are arranged in this order. This printing system 1 causes the pre-stage drier 3 to dry a printing medium M to which a printing has been executed by the pre-stage printing apparatus 2 and causes the post-stage drier 7 to dry the printing medium M to which a printing has been executed by the post-stage printing apparatus 6 while the printing medium M is conveyed in a roll-to-roll manner from a feed roll 11 to a wind-up roll 12. Here, a case where a printing is executed to the printing medium M, which is a transparent film, with emulsion inks is illustrated and described. Further, out of both surfaces of the printing medium M, the surface on which an image is to be printed is referred to as a front surface and the surface opposite to the front surface is referred to as a back surface as appropriate.

Figure 2:
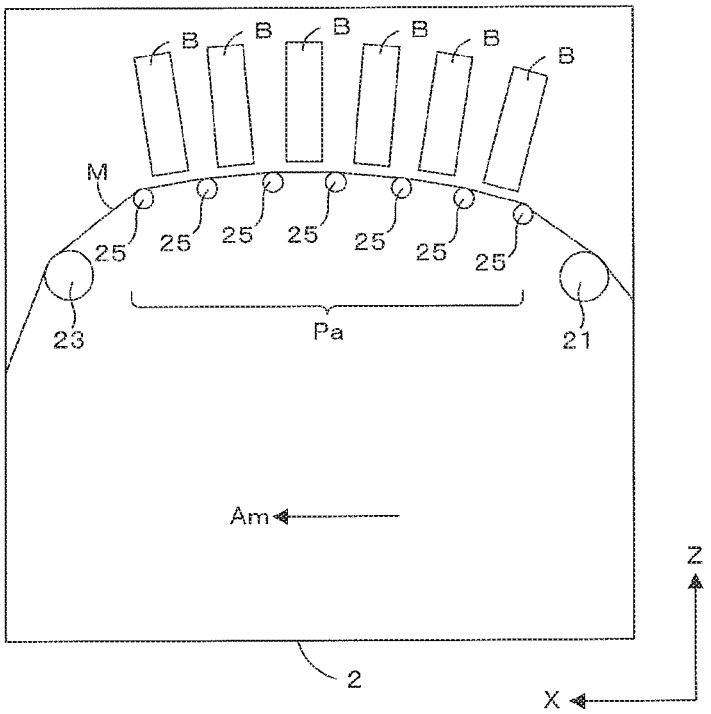
FIG. 2 is a front view schematically showing the pre-stage printing apparatus provided in the printing system of FIG. 1.

FIG. 2 is a front view schematically showing the pre-stage printing apparatus provided in the printing system of FIG. 1. In the pre-stage printing apparatus 2, the printing medium M is conveyed along a conveying direction Am from left to right of FIG. 2. This pre-stage printing apparatus 2 includes a carry-in roller 21 which carries in the printing medium M fed from the feed roll 11 and a carry-out roller 23 which carries out the printing medium M toward the pre-stage drier 3. The back surface of the printing medium M is wound by the carry-in roller 21 and the carry-out roller 23 from below and driven in the conveying direction Am by the carry-in roller 21 and the carry-out roller 23. Further, the pre-stage printing apparatus 2 includes a plurality of backup rollers 25 arranged between the carry-in roller 21 and the carry-out roller 23 in the conveying direction Am. The back surface of the printing medium M being conveyed in the conveying direction Am is wound from below by each of these backup rollers 25 supporting the printing medium M.

A pre-stage printing path Pa is formed between the most upstream backup roller 25 and the most downstream backup roller 25 in the conveying direction Am, out of the plurality of backup rollers 25. The most upstream and most downstream backup rollers 25 support the printing medium M at the same height, and the backup rollers 25 more inward of the pre-stage printing path Pa support the printing medium M at higher positions.

Further, the pre-stage printing apparatus 2 includes a plurality of print bars B arranged in the conveying direction Am above the printing medium M being conveyed along the pre-stage printing path Pa and facing the front surface of the printing medium M. Specifically, the print bar B is arranged to face the front surface of a part of the printing medium M moving between two adjacent backup rollers 25, and each print bar B discharges an ink in an inkjet method to the front surface of a part of the printing medium M having both sides supported by two backup rollers 25 in this way. In an example shown here, there are provided six print bars B including four print bars B which discharge inks of four process colors (yellow, magenta, cyan, black) and two print bars B which discharge two special color inks (orange, violet). Therefore, the pre-stage printing apparatus 2 can print a color image on the front surface of the printing medium M by the six print bars B which discharge the color inks having mutually different colors.

The printing medium M having the image printed in the pre-stage printing path Pa moves obliquely downward between the most downstream backup roller 25 of the pre-stage printing path Pa and the carry-out roller 23 and reaches the carry-out roller 23. The back surface of the printing medium M is wound by the carry-out roller 23 from below on a side downstream of the plurality of backup rollers 25 in the conveying direction Am. Then, the carry-out roller 23 carries out the printing medium M to the pre-stage drier 3. Note that the carry-out roller 23 is a suction roller which sucks the back surface of the printing medium M and stabilizes the position of the printing medium M in the pre-stage printing path Pa by suppressing the transmission of the vibration of the printing medium M from the pre-stage drier 3 to the pre-stage printing apparatus 2. As a result, the influence of the conveyance of the printing medium M in the pre-stage drier 3 on printing in the pre-stage printing apparatus 2 can be suppressed.

As shown in FIG. 1, the pre-stage drier 3 dries the printing medium M while appropriately folding the conveying direction Am of the printing medium M in the Z direction. Then, the printing medium M dried in the pre-stage drier 3 is carried out to the post-stage printing apparatus 6 from the pre-stage drier 3.

Figure 3:
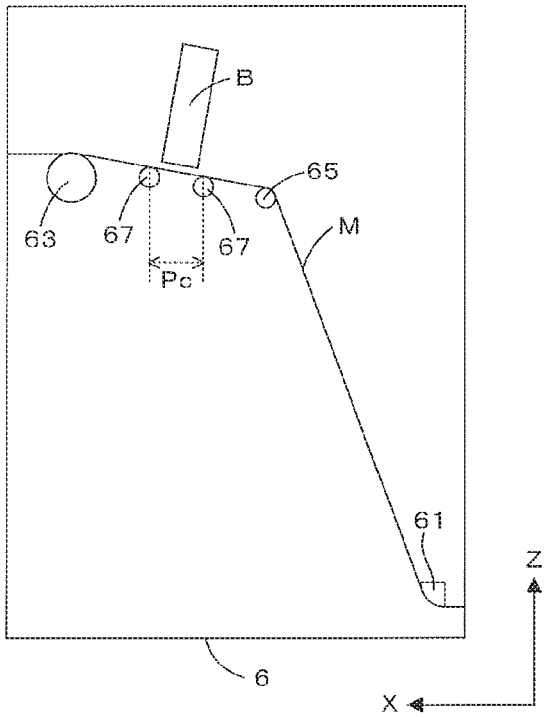
FIG. 3 is a front view schematically showing the post-stage printing apparatus provided in the printing system of FIG. 1.

FIG. 3 is a front view schematically showing the post-stage printing apparatus provided in the printing system of FIG. 1. The post-stage printing apparatus 6 includes an air turn bar 61 which folds the printing medium M carried out in the X direction from the pre-stage drier 3 obliquely upwardly. The front surface of the printing medium M is wound by this air turn bar 61 while a clearance is providing between the front surface of the printing medium M and the air turn bar 61 by injecting air. Further, the post-stage printing apparatus 6 includes a carry-out roller 63 for carrying out the printing medium M toward the post-stage drier 7 and a conveyor roller 65 arranged between the air turn bar 61 and the carry-out roller 63. The back surface of the printing medium M is wound from below by the conveyor roller 65 and the carry-out roller 63 and the printing medium M is driven in the conveying direction by the conveyor roller 65 and the carry-out roller 63.

Further, the post-stage printing apparatus 6 includes two backup rollers 67 between the conveyor roller 65 and the carry-out roller 63. A post-stage printing path Pc is formed between the two backup rollers 67. Further, the post-stage printing apparatus 6 includes a print bar B facing the front surface of the printing medium M above the printing medium M being conveyed along the post-stage printing path Pc. Specifically, the print bar B is arranged to face a part of the printing medium M moving between the two backup rollers 67, and discharges an ink in the inkjet method to the front surface of the part of the printing medium M having both sides supported by the two backup rollers 67. In an example shown here, the print bar B discharges a white ink. Therefore, the post-stage printing apparatus 6 can print a white background image on the front surface of the printing medium M by the print bar B with respect to the color image printed in the pre-stage printing apparatus 2.

The printing medium M having the image printed in the post-stage printing path Pc moves obliquely upward between the most downstream backup roller 67 of the post-stage printing path Pc and the carry-out roller 63 and reaches the carry-out roller 63. The printing medium M is wound by this carry-out roller 63 from below on a side downstream of the two backup rollers 67 in the conveying direction Am. The carry-out roller 63 carries out the printing medium M to the post-stage drier 7 along a moving path of the printing medium M in the X direction by winding the printing medium M obliquely moving upward from the post-stage printing path Pc in this way. Note that the carry-out roller 63 is a suction roller which sucks the back surface of the printing medium M and stabilizes the position of the printing medium M in the post-stage printing path Pc by suppressing the transmission of the vibration of the printing medium M from the post-stage drier 7 to the post-stage printing apparatus 6. As a result, the influence of the conveyance of the printing medium M in the post-stage drier 7 on printing in the post-stage printing apparatus 6 can be suppressed.

As shown in FIG. 1, the post-stage drier 7 dries the printing medium M while appropriately folding the conveying direction Am of the printing medium M in the X direction. Then, the printing medium M dried in the post-stage drier 7 is carried out from the post-stage drier 7 and wound on the wind-up roll 12.

As described above, the print bars B provided in the pre-stage printing apparatus 2 and the post-stage printing apparatus 6 discharge the liquids (inks) in the inkjet method. Specifically, a plurality of discharge heads H (FIGS. 4 and 5) which discharge the liquid from a plurality of nozzles N arrayed in the Y direction to the printing medium M are arrayed in the Y direction in a bottom part of the print bar B.

Figure 4:
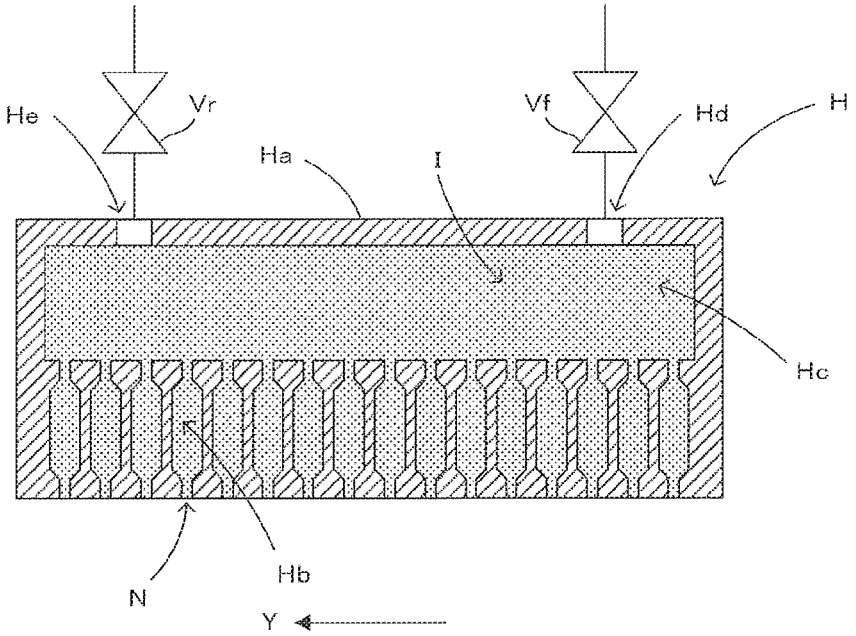
FIG. 4 is a diagram schematically showing the configuration of the discharge head.

FIG. 4 is a diagram schematically showing the configuration of the discharge head. As shown in FIG. 4, the discharge head H includes a housing Ha and the plurality of nozzles N are arrayed in the Y direction and open in a bottom part of the housing Ha. A plurality of cavities Hb respectively communicating with the plurality of nozzles N and a ink supply chamber Hc communicating with the plurality of cavities Hb are provided inside the housing Ha, and an ink I supplied from the ink supply chamber Hc is stored in the cavities Hb. Then, piezoelectric elements provided in the cavities Hb push the ink I from the cavities Hb, whereby the ink I is discharged from the nozzles N communicating with the cavities Hb. Note that a specific method for discharging the ink I is not limited to a method by the piezoelectric elements and may be a thermal method for heating the ink I. Further, an ink supply port Hd and an ink recovery port He are respectively open in an upper part of the discharge head H, and the ink I is supplied to the ink supply chamber Hc via the ink supply port Hd and recovered from the ink supply chamber Hc via the ink recovery port He.

Figure 5:
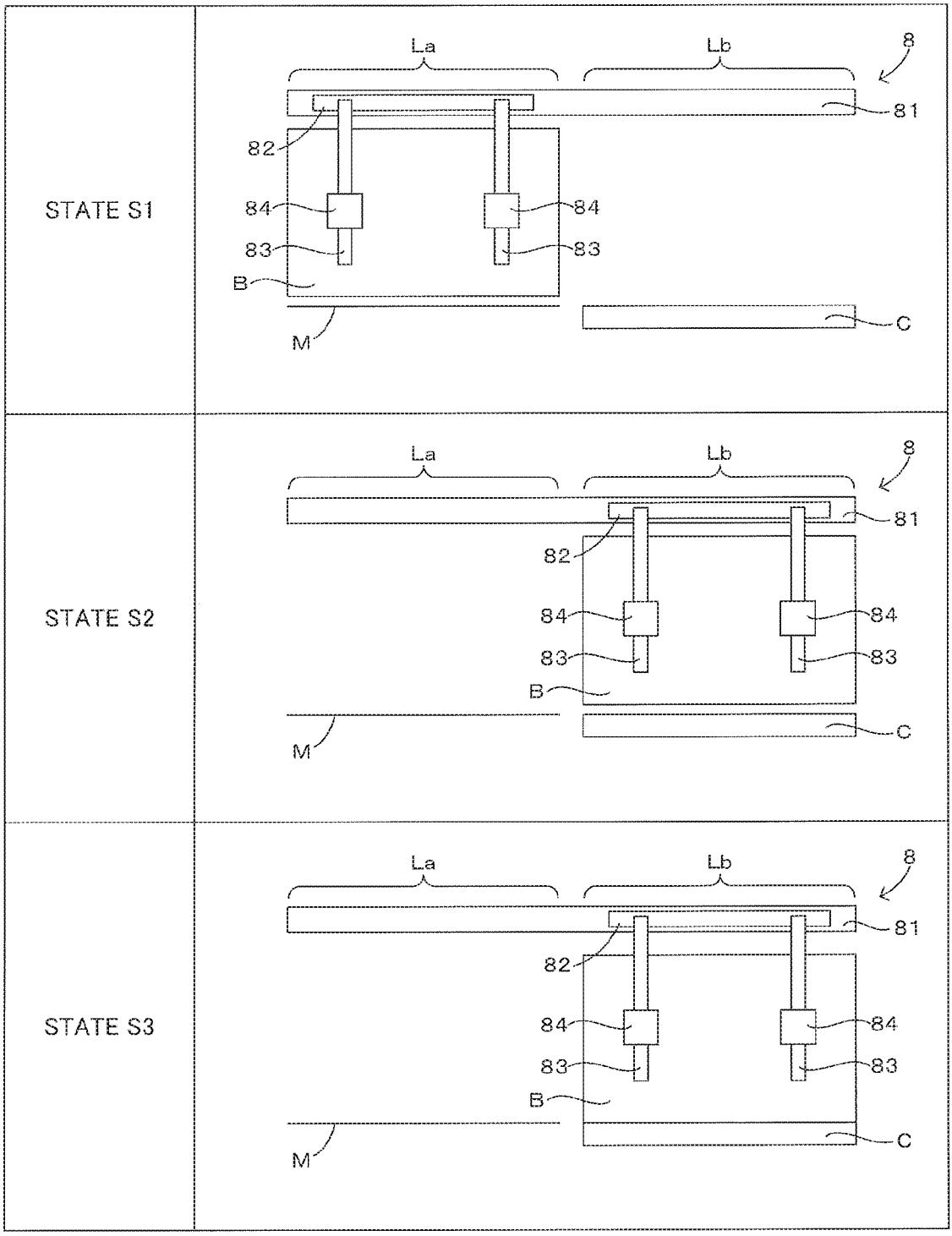
FIG. 5 is side views schematically showing the configuration of the bar drive mechanism which drives the print bar.

A bar drive mechanism 8 (FIG. 5) which drives the print bar B is provided for each print bar B thus configured in each of the pre-stage printing apparatus 2 and the post-stage printing apparatus 6. FIG. 5 is side views schematically showing the configuration of the bar drive mechanism which drives the print bar. Since a driving mode of the print bar B by the bar drive mechanism 8 is similar for each of the print bars B of the pre-stage printing apparatus 2 and the post-stage printing apparatus 6, the bar drive mechanism 8 is described, showing one print bar B here.

As shown in FIG. 5, the print bar B is selectively located at either one of a facing position La and a retracted position Lb different in the Y direction. Each discharge head H of the print bar B faces the printing medium M if the print bar B is located at the facing position La, whereas each discharge head H of the print bar B is retracted from the printing medium M in the Y direction and not facing the printing medium M if the print bar B is located at the retracted position Lb. A cap C is facing this retracted position Lb from below. That is, the cap C is facing each discharge head H of the print bar B located at the retracted position Lb from below.

In correspondence with this, the bar drive mechanism 8 includes a Y-axis rail 81 provided in parallel to the Y direction and a movable member 82 configured to move in the Y direction along the Y-axis rail 81, and the print bar B is attached to the movable member 82. Thus, the print bar B can move between the facing position La and the retracted position Lb by moving in the Y direction, accompanying the movable member 82.

Further, the bar drive mechanism 8 includes elevation rails 83 attached to the movable member 82 and movable members 84 configured to move upward and downward along the elevation rails 83, and the print bar B is mounted on these movable members 84. That is, the print bar B is attached to the movable member 82 via the elevation rails 83 and the movable members 84, and the elevation rails 83, the movable members 84 and the print bar B move in the Y direction as the movable member 82 moves. Furthermore, the print bar B moves upward and downward as the movable members 83 move upward and downward along the elevation rails 83.

Such a bar drive mechanism 8 can drive the print bar B in the Y direction, can move the print bar B upward and downward, and can drive the print bar B as shown in states S1 to S3 of FIG. 5. In the state S1, the print bar B is located at the facing position La and facing the printing medium M. In the case of performing printing on the printing medium M by discharging the ink from the nozzles N of each discharge head H of the print bar B, the print bar B is located at the facing position La. In states S2 and S3, the print bar B is located at the retracted position Lb and facing the cap C from above. However, in the state S2, the print bar B is located at an upper position and a clearance is formed between the print bar B and the cap C. In contrast, in the state S3, the print bar B is located at a lower position lower than the upper position and in contact with the cap C from above. That is, in the state S3, capping is performed to cover the nozzles N of each discharge head H of the print bar B by the cap C.

Figure 6:
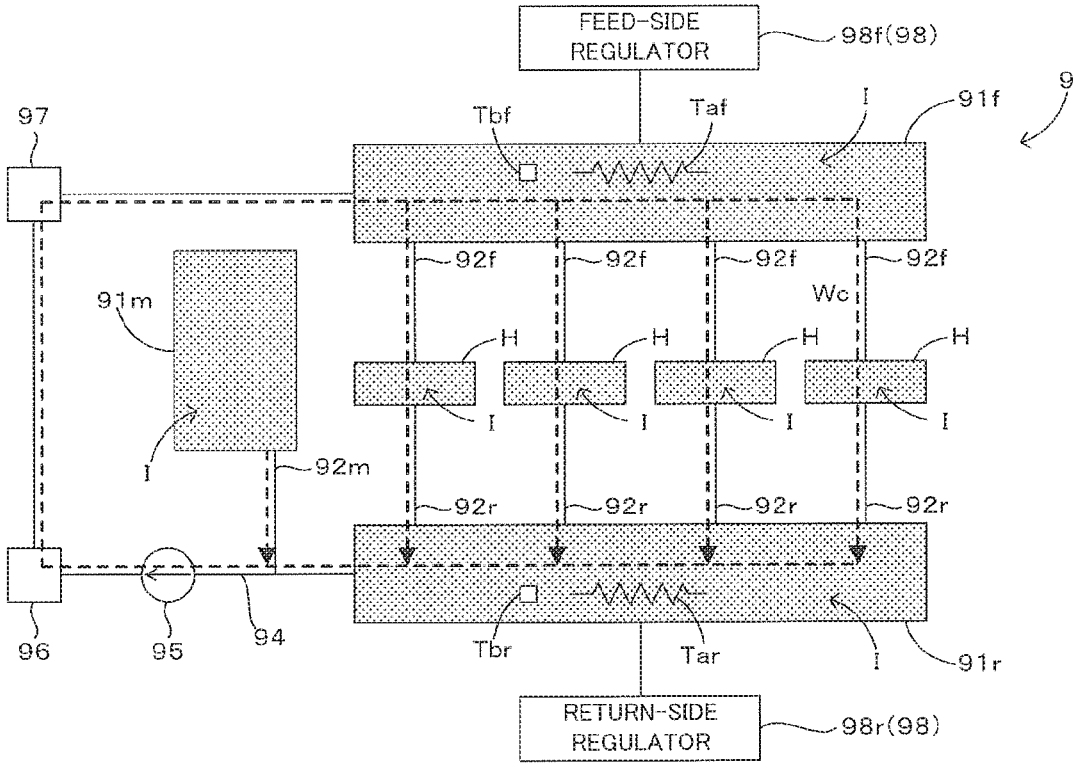
FIG. 6 is a diagram schematically showing the configuration of an ink supply device which supplies the ink to the discharge heads of FIG. 4.

FIG. 6 is a diagram schematically showing the configuration of an ink supply device which supplies the ink to the discharge heads of FIG. 4. In FIG. 6, the ink I present in the ink supply device 9 is shown by dot hatching. Each of the pre-stage printing apparatus 2 and the post-stage printing apparatus 6 includes the ink supply device 9 for each print bar B. However, since the configuration of the ink supply device 9 is common for each print bar B, the configuration of the ink supply device 9 for one print bar B is described here.

The ink supply device 9 includes a feed reservoir 91*f* which stores the ink and feed pipes 92*f* (feed channels) connecting the feed reservoir 91*f* and the ink supply ports Hd of the discharge heads H. The ink I flowing out from the feed reservoir 91*f* to the feed pipes 92*f* is supplied to the ink supply chambers Hc via the ink supply ports Hd. Further, the ink supply device 9 includes a return reservoir 91*r* which stores the ink I and return pipes 92*r* (return channels) connecting the return reservoir 91*r* and the ink recovery ports He of the discharge heads H. The ink I flowing out from the ink supply chambers Hc of the discharge heads H to the return pipes 92*r* via the ink recovery ports He is recovered into the return reservoir 91*r*.

Further, the ink supply device 9 includes a feed heater Taf which heats the ink I in the feed reservoir 91*f* and a feed thermometer Tbf which detects the temperature of the ink I in the feed reservoir 91*f*. Similarly, the ink supply device 9 includes a return heater Tar which heats the ink I in the return reservoir 91*r* and a return thermometer Tbr which detects the temperature of the ink I in the return reservoir 91*r*.

Furthermore, the ink supply device 9 includes a reservoir communication pipe 94 (reservoir communication channel) connecting the return reservoir 91*r* and the feed reservoir 91*f*. This reservoir communication pipe 94 is a pipe allowing communication between the return reservoir 91*r* and the feed reservoir 91*f*, and the ink I moves in the reservoir communication pipe 94 from the return reservoir 91*r* toward the feed reservoir 91*f*.

A circulation pump 95, a filter 96 and a degasser 97 are provided to the reservoir communication pipe 94. The circulation pump 95, the filter 96 and the degasser 97 are arranged in this order in a flowing direction of the ink I in the reservoir communication pipe 94. The circulation pump 95 is a diaphragm pump and functions to feed the ink I flowing out from the return reservoir 91*r* to the feed reservoir 91*f* along the reservoir communication pipe 94. The filter 96 removes solids from the ink I flowing in the reservoir communication pipe 94 before flowing into the feed reservoir 91*f*, and the degasser 97 removes gases from the ink I flowing in the reservoir communication pipe 94 before flowing into the feed reservoir 91*f*.

Further, the ink supply device 9 includes a main reservoir 91*m* capable of storing a large amount of the ink I, and an ink supply pipe 92*m* connecting the main reservoir 91*m* and the reservoir communication pipe 94. Specifically, the ink supply pipe 92*m* connects a part of the reservoir communication pipe 94 between the return reservoir 91*r* and the circulation pump 95 and the main reservoir 91*m*. The ink I stored in the main reservoir 91*m* is supplied into the reservoir communication pipe 94 via the ink supply pipe 92*m*.

Furthermore, the ink supply device 9 includes a pressure regulation mechanism 98 which regulates pressures to be respectively applied to the feed reservoir 91*f* and the return reservoir 91*r*. This pressure regulation mechanism 98 includes a feed-side regulating part 98*f* which regulates the pressure to be applied to the feed reservoir 91*f* and a return-side regulating part 98*r* which regulates the pressure to be applied to the return reservoir 91*r*. These feed-side regulating part 98*f* and the return-side regulating part 98*r* have a common configuration and respectively apply negative pressures generated in negative pressure tanks by decompressing the negative pressure tanks by negative pressure pumps to the feed reservoir 91*f* and the return reservoir 91*r*.

In such an ink supply device 9, a feed-side regulator 98*f* and a return-side regulator 98*r* (pressure regulation mechanism 98) circulate the ink I along a circulation channel Wc shown by broken lines by generating a negative pressure difference ΔP between the feed reservoir 91*f* and the return reservoir 91*r*. Here, the circulation channel Wc is a channel in which the ink I returns from the return reservoir 91*r* to the feed reservoir 91*f* via the reservoir communication pipe 94 after the ink I reaches the return reservoir 91*r* from the feed reservoir 91*f* by way of the discharge heads H.

Specifically, the feed-side regulator 98*f* regulates a pressure Pf in the feed reservoir 91*f* to a negative pressure and the return-side regulator 98*r* regulates a pressure Pr in the return reservoir 91*r* to a negative pressure lower than the pressure Pf. In this way, the negative pressure difference ΔP is generated between the pressure Pf in the feed reservoir 91*f* and the pressure Pr in the return reservoir 91*r*, and a pressure from the feed reservoir 91*f* toward the return reservoir 91*r* is applied to the ink I. Further, during the generation of the negative pressure difference ΔP, a controller 100 prevents a decrease of the negative pressure difference ΔP by operating the circulation pump 95 and causing the circulation pump 95 to discharge the ink I from the return reservoir 91*r* toward the feed reservoir 91*f*. The ink I is circulated in the circulation channel Wc by such a negative pressure difference ΔP.

Figure 7:
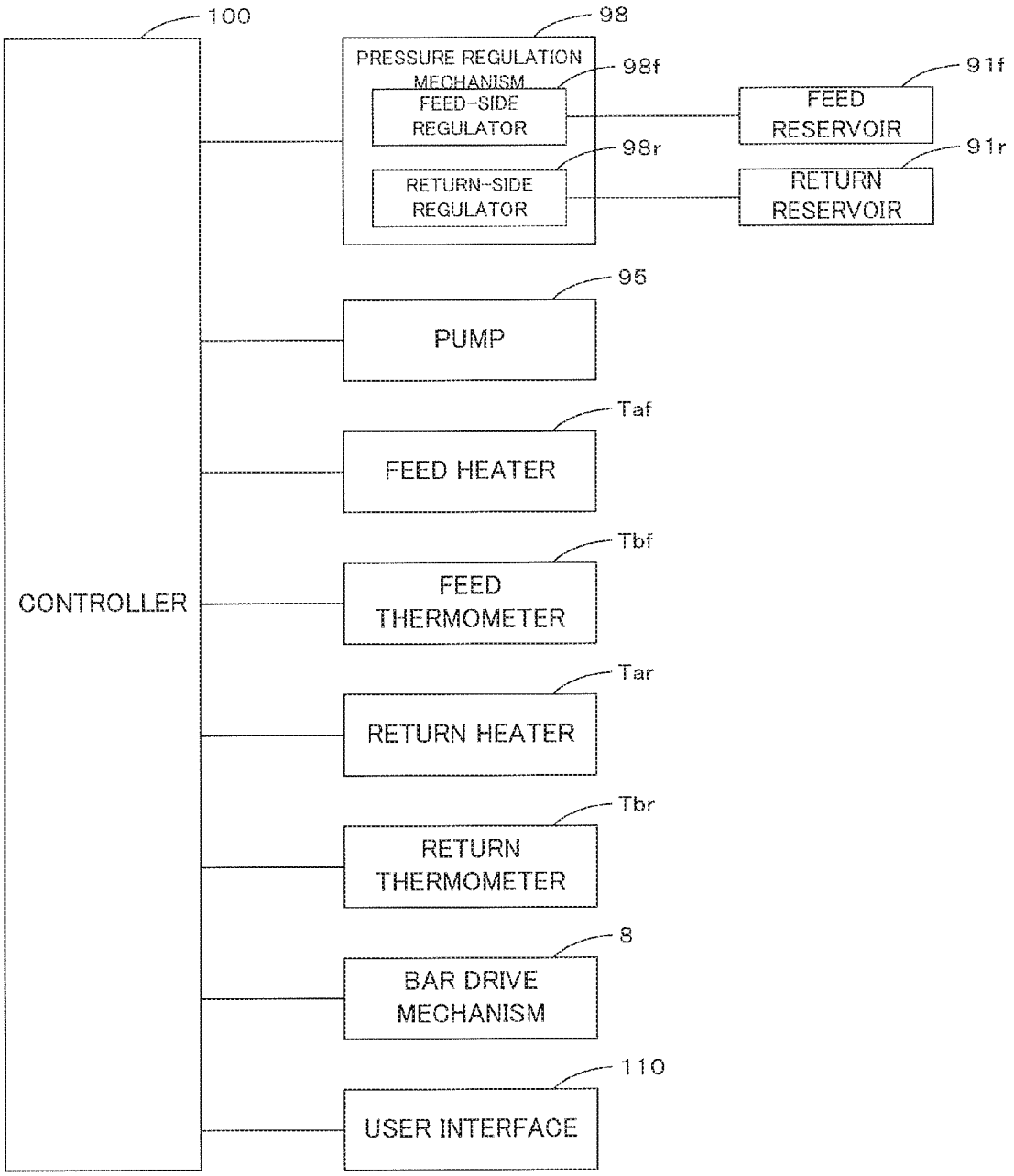
FIG. 7 is a diagram showing electrical configurations of the pre-stage printing apparatus and the post-stage printing apparatus.

FIG. 7 is a diagram showing electrical configurations of the pre-stage printing apparatus and the post-stage printing apparatus. Note that since the configuration of FIG. 7 is common to the pre-stage printing apparatus 2 and the post-stage printing apparatus 6, the pre-stage printing apparatus 2 and the post-stage printing apparatus 6 are described without being particularly distinguished here. As shown in FIG. 7, the printing apparatus 2, 6 includes a controller 100, which is a processor such as a CPU (Central Processing Unit).

The controller 100 generates the negative pressure difference ΔP between the feed reservoir 91*f* and the return reservoir 91*r* by controlling the feed-side regulator 98*f* and the return-side regulator 98*r* of the pressure regulation mechanism 98. Particularly, the controller 100 generates two mutually different negative pressure differences ΔP, i.e. a normal negative pressure difference ΔPo and a low negative pressure difference ΔPl. The low negative pressure difference ΔPl is smaller than the normal negative pressure difference ΔPo. Thus, in a state where the normal negative pressure difference ΔPo is generated between the feed reservoir 91*f* and the return reservoir 91*r*, the ink I is circulated at a normal flow rate Vo along the circulation channel Wc (normal circulation). On the other hand, in a state where the low negative pressure difference ΔPl is generated between the feed reservoir 91*f* and the return reservoir 91*r*, the ink I is circulated at a low-speed flow rate Vl lower than the normal flow rate Vo along the circulation channel Wc (low-speed circulation). Further, the controller 100 also controls the operation of the circulation pump 95 according to a difference between the normal negative pressure difference ΔPO and the low negative pressure difference ΔPl.

This controller 100 controls the temperature of the ink I in the feed reservoir 91*f* to a predetermined printing temperature Tp by feedback-controlling an output of the feed heater Taf based on the temperature of the ink I detected by the feed thermometer Tbf. Similarly, the controller 100 controls the temperature of the ink I in the return reservoir 91*r* to the printing temperature Tp by feedback-controlling an output of the return heater Tar based on the temperature of the ink I detected by the return thermometer Tbr.

Further, the controller 100 drives the print bar B by controlling the bar drive mechanism 8. In this way, the print bar B is in any one of the three states S1 to S3 shown in FIG. 5.

Further, the printing apparatus 2, 6 includes a user interface 110. The user interface 110 is, for example, constituted by a touch panel display, and functions to receive an input operation of a user and notify various pieces of information to the user. Then, the controller 110 executes a control corresponding to the input operation of the user performed on the user interface 110.

Figure 8:
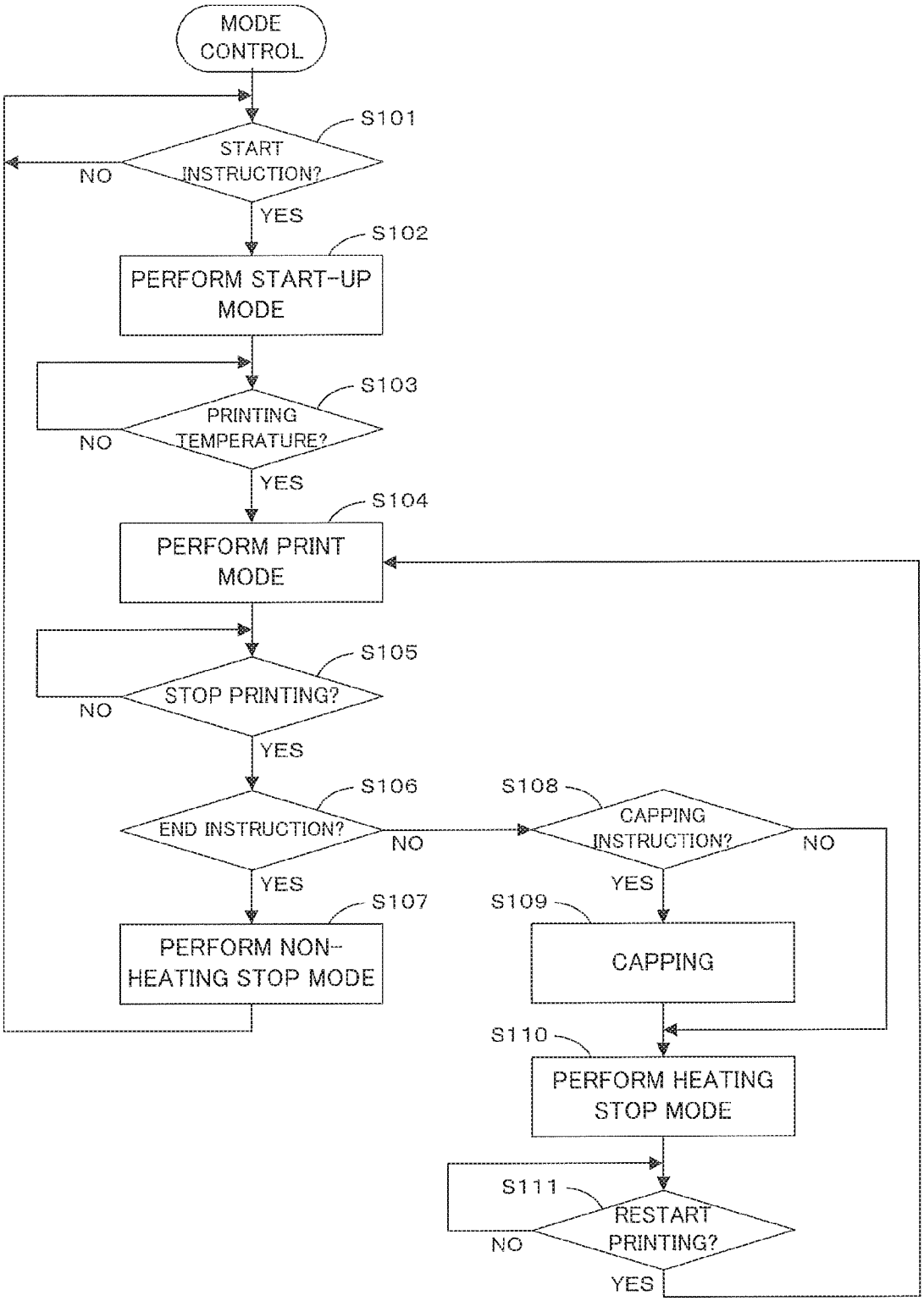
FIG. 8 is a flow chart showing an example of the mode control and the mode control of FIG. 8 is performed by the controller 100.

Particularly, the controller 100 controls the following modes performed in the printing apparatus 2, 6. Next, this mode control is described using FIGS. 8 and 9. FIG. 8 is a flow chart showing an example of the mode control and the mode control of FIG. 8 is performed by the controller 100. FIG. 9 is a table showing contents set in the mode control of FIG. 8. In FIG. 9, a circulation flow rate of the ink I in the circulation channel Wc, the presence or absence (ON/OFF) of heating by the heater Taf, Tar and an execution mode (ON/OFF/user selection) of the capping are shown for each mode.

In Step S101, the controller 100 confirms whether or not a start instruction has been input to the user interface 110 by the user. Here, a non-heating stop mode (Step S107) to be described later is performed until the start instruction is input. If the input of the start instruction is confirmed ("YES" in Step S101), the controller 100 performs a start-up mode (Step S102). As shown in FIG. 9, the capping is performed for the print bar B in the start-up mode. Accordingly, the controller 100 brings the print bar B into contact with the cap C at the retracted position Lb by controlling the bar drive mechanism 8 (State S3). With the capping performed in this way, the controller 100 starts to heat the ink I by the feed heater Taf and the return heater Tar while the ink I is circulated at the normal flow rate Vo along the circulation channel Wc (normal circulation) by generating the normal negative pressure difference ΔPo between the feed reservoir 91*f* and the return reservoir 91*r*.

Then, when confirming that both the detected temperature of the feed thermometer Tbf and that of the return thermometer Tbr have reached the printing temperature Tp ("YES" in Step S103), the controller 100 performs a print mode (Step S104). As shown in FIG. 9, in the print mode, the controller 100 controls the temperature of the ink I to the printing temperature Tp by the feed heater Taf and the return heater Tar while circulating the ink I at the normal flow rate Vo along the circulation channel Wc (normal circulation). Since the contents of setting of the print mode and the start-up mode are the same for the circulation flow rate and the heating of the ink I as just described, the controller 100 needs not change the setting in performing the print mode following the start-up mode.

On the other hand, the content of setting is different between the start-up mode and the print mode for the capping, and the print bar B needs to be located at the facing position La to face the printing medium M in the print mode. Here, to perform the print mode following the start-up mode, the controller 100 moves the print bar B from the retracted position Lb to the facing position La (state S1) after moving the print bar B in contact with the cap C upward (state S2). If a movement of the print bar B to the facing position La is completed in this way, the discharge heads H start to discharge the ink I from the nozzles N and an image is printed on the printing medium M.

In Step S105, the controller 100 judges whether or not the printing of the image by the print mode has been completed and the print mode is to be stopped (Step S105). In the case of stopping the print mode ("YES" in Step S105), it is confirmed whether or not an end instruction has been input to the user interface 110 by the user. For example, the user inputs the end instruction such as when the user goes home after finishing one day operation of the printing apparatuses 2, 6.

If the input of the end instruction is confirmed ("YES" in Step S106), the controller 100 performs the non-heating stop mode (Step S107). As shown in FIG. 9, in the non-heating stop mode, the controller 100 stops the heating of the ink I by the feed heater Taf and the return heater Tar while circulating the ink I at the low-speed flow rate Vl along the circulation channel We (low-speed circulation) by generating the low negative pressure difference ΔPl between the feed reservoir 91*f* and the return reservoir 91*r*.

Further, as shown in FIG. 9, the capping is performed in the non-heating stop mode. Here, to perform the non-heating stop mode following the print mode, the controller 100 lowers the print bar B and brings the print bar B into contact with the cap C (state S3) after moving the print bar B from the facing position La to the retracted position Lb (state S2). Then, return is made to Step S101.

On the other hand, if the input of the end instruction is not confirmed in Step S106 ("NO" in Step S106), the controller 100 confirms whether or not a capping instruction has been input to the user interface 110 by the user to perform the capping every time the print mode is stopped. For example, the user can judge not to input the capping instruction if the print mode is repeated at short intervals and, on the other hand, can judge to input the capping instruction if the print mode is repeated at long intervals.

If the input of the capping instruction is confirmed ("YES" in Step S108), the controller 100 proceeds to Step S110 after performing the capping by lowering the print bar B moved from the facing position La to the retracted position Lb and bringing the print bar B into contact with the cap C (Step S109). On the other hand, unless the input of the capping instruction is confirmed ("NO" in Step S108), the controller 100 proceeds to Step S110 without performing the capping.

As shown in FIG. 9, in the heating stop mode performed in Step S110, the controller 10 heats the ink I by the feed heater Taf and the return heater Tar while circulating the ink I at the low-speed flow rate Vl along the circulation channel We (low-speed circulation) by generating the negative pressure difference ΔPl between the feed reservoir 91*r* and the return reservoir 91*r*. Here, to perform the heating stop mode following the print mode, the controller 100 continues to heat the ink from the print mode to the heating stop mode.

In Step S111, the controller 100 confirms whether or not an instruction to restart the print mode (Step S104) has been input to the user interface 110 by the user. If the input of the instruction to restart the print mode is confirmed ("YES" in Step S111), return is made to Step S104.

In the embodiment described above, the ink I is circulated along the circulation channel Wc at the low-speed flow rate Vl lower than that during the execution of the print mode when the print mode is stopped (Steps S107, S110). By circulatingly supplying the ink I to the discharge heads H in this way, the deterioration of the ink I can be also suppressed while the drying of the ink I is suppressed.

Particularly in the ink supply device 9 shown in FIG. 6, a mechanical load by the circulation pump 95 and the filter 96 is applied to an emulsion ink if the ink I is circulated at a high flow velocity along the circulation channel Wc. Particularly, if a diaphragm pump is used as the circulation pump 95, a high shear is applied to the ink I in feeding the ink I. Thus, the destruction/aggregation of the emulsion is easily induced. As a result, the filter 96 is clogged to deteriorate the flow of the ink I, wherefore air bubbles and aggregates may be mixed into the ink I and the print quality may be reduced. If the print quality is reduced in this way, the replacement of the ink I or the exchange of the discharge heads H becomes necessary, requiring much time and labor and more cost. In contrast, such a problem can be effectively avoided according to the above embodiment.

Further, the feed heater Taf and the return heater Tar (heating unit) which heats the ink I are equipped. The controller 100 heats the ink I by the feed heater Taf and the return heater Tar when the print mode is performed (Step S104). By heating the ink I in this way, the ink I can be stably discharged from the nozzles N.

If a heating time of the ink I becomes longer, the ink I may be dried/solidified to clog the nozzles N of the discharge heads H. To deal with this, a configuration for stopping the heating of the ink I when the print mode is stopped is considered. However, since it takes a long time to heat the ink I, a problem of delaying the restart of the print mode due to the heating of the ink I when the print mode is restarted after the heating of the ink I is stopped as the print mode is stopped is assumed.

In contrast, the controller 100 selectively performs the heating stop mode for causing the pressure regulation mechanism 98 to perform the low-speed circulation while causing the feed heater Taf and the return heater Tar to heat the ink I (Step S110) and the non-heating stop mode for causing the pressure regulation mechanism 98 to perform the low-speed circulation without causing the feed heater Taf and the return heater Tar to heat the ink I (Step S107) when the print mode is stopped. In such a configuration, for example, the print mode can be quickly restarted by selecting the heating stop mode (Step S110) when the print mode is stopped if a time to the next print mode is expected to be short, whereas the drying/solidification of the ink I can be suppressed by selecting the non-heating stop mode (Step S107) when the print mode is stopped if a time to the next print mode is expected to be long.

Further, the user interface 110 which receives an end instruction by the user is equipped. The controller 100 performs the heating stop mode (Step S110) when the print mode is stopped while not receiving the end instruction ("NO" in Step S106), and performs the non-heating stop mode (Step S107) when the print mode is stopped if the user interface 110 receives the end instruction ("YES" in Step S106). In such a configuration, if there is no end instruction from the user, the heating stop mode (Step S110) is performed when the print mode is stopped. Thus, the print mode can be quickly restarted (Step S104). On the other hand, if there is an end instruction from the user, the non-heating stop mode (Step S107) is performed when the print mode is stopped. Thus, the drying/solidification of the ink I can be suppressed. Accordingly, the user may select the heating stop mode (Step S110) if a time to the restart of the print mode is expected to be short and may select the non-heating stop mode (Step S107) if a time to the restart of the print mode is expected to be long. Therefore, the ink I can be properly heated according to the user's situation judgment.

Further, the cap C which performs the capping to cover the nozzles N of the discharge heads H is equipped. The controller 100 causes the cap C to perform the capping when the non-heating stop mode is performed (Step S107). In such a configuration, the nozzles N of the discharge heads H are covered by the cap C at the time of the non-heating stop mode (Step S107), wherefore the drying/solidification of the nozzles N can be more effectively suppressed.

Further, the user interface 110 receives the capping instruction instructing to perform the capping when the heating stop mode is performed (Step S110). Then, the controller 10 causes the cap C to perform the capping (Step S109) when the heating stop mode is performed (Step S110) if the user interface 110 receives the capping instruction ("YES" in Step S108). On the other hand, the controller 100 does not cause the cap C to perform the capping when the heating stop mode is performed (Step S110) if the user interface 110 does not receive the capping instruction ("NO" in Step S108). That is, the print bar B is continuously located at the facing position La from the print mode (Step S104). In such a configuration, the user can suppress the drying/solidification of the ink I in the heating stop mode (Step S110) by giving the capping instruction to the user interface 110. On the other hand, the user can quickly restart the print mode (Step S104) by not giving the capping instruction to eliminate a time required to release the capping. Therefore, the capping can be properly performed according to the user's situation judgment.

Further, the user interface 110 receives the start instruction by the user. The controller 100 performs the start-up mode for causing the pressure regulation mechanism 98 to perform the normal circulation with the cap C caused to perform the capping and causing the feed heater Taf and the return heater Tar to heat the ink I during a period until the start of the print mode (Step S104) associated with the start instruction if the user interface 110 receives the start instruction ("YES" in Step S101). In such a configuration, since the capping is performed during the period until the start of the print mode, the start of the print mode (Step S104) can be waited while the drying/solidification of the ink I is suppressed.

In the embodiment described above, the pre-stage printing apparatus 2 or the post-stage printing apparatus 6 corresponds to an example of a "printing apparatus" of the invention, the pressure regulation mechanism 98 corresponds to an example of an "ink feeding unit" of the invention, the controller 100 corresponds to an example of a "control unit" of the invention, the user interface 110 corresponds to examples of a "first operating unit", a "second operating unit" and a "third operating unit" of the invention, the cap C corresponds to an example of a "cap" of the invention, the discharge head H corresponds to an example of a "discharge head" of the invention, the nozzle N corresponds to an example of a "nozzle" of the invention, the feed heater Taf and the return heater Tar correspond to an example of a "heating unit" of the invention, the circulation channel We corresponds to an example of a "circulation channel" of the invention, Step S102 corresponds to an example of a "start-up mode" of the invention, Step S104 corresponds to an example of a "print mode" of the invention, Step S107 corresponds to an example of a "non-heating stop mode" of the invention, and Step S110 corresponds to an example of a "heating stop mode" of the invention.

Note that the invention is not limited to the above embodiment and various changes other than the aforementioned ones can be made without departing from the gist of the invention. For example, the mode control can be changed as appropriate. Specifically, the capping may be performed regardless of the type of the mode. Alternatively, the ink I may be heated regardless of the type of the mode or the non-heating stop mode may be performed instead of the heating stop mode in Step S110.

Further, the type of the circulation pump 95 is not limited to the diaphragm pump and a pump other than the diaphragm pump can be used as the circulation pump 95.

Further, a replenishment destination of the ink I from the main reservoir 91*m* is not limited to the reservoir communication pipe 94. Therefore, the ink I may be replenished from the main reservoir 91*m* to the feed reservoir 91*f* via the ink supply pipe 92*m* or may be replenished from the main reservoir 91*m* to the return reservoir 91*r* via the ink supply pipe 92*m*.

Further, the types of the color inks to be discharged to the printing medium M in the pre-stage printing apparatus 2 are not limited to the above six colors.

Further, a printing apparatus for discharging a white ink may be provided upstream of the pre-stage printing apparatus 2 in the conveying direction Am, and the color inks may be discharged to the printing medium M after the white ink is discharged to the printing medium M.

Further, the white ink may be printed on the printing medium M by analog printing like flexographic printing or gravure printing.

Further, the pre-stage printing apparatus 2 may stop the printing medium M on a platen and discharge the color inks from the nozzles N while the print bars B are operated in an orthogonal direction Ar.

Further, the material of the printing medium M is not limited to a film and may be paper or the like.

Further, the types of the inks are not limited to emulsion inks and may be water-based inks with dispersed pigment or UV (UltraViolet) inks. In the case of using UV inks, light irradiation apparatuses for irradiating ultraviolet rays to the UV inks on the printing medium M are arranged instead of the pre-stage drier 3 and the post-stage drier 7.

The invention is applicable to printing techniques in general.

As described above, the printing apparatus may comprises a heating unit which heats the ink, wherein, the control unit causes the heating unit to heat the ink when the print mode is performed. By heating the ink in this way, the ink can be stably discharged from the nozzle.

If a heating time of the ink becomes longer, the ink may be dried/solidified to clog the nozzle of the discharge head. To deal with this, a configuration for stopping the heating of the ink when the print mode is stopped is considered. However, since it takes a long time to heat the ink, a problem of delaying the restart of the print mode due to the heating of the ink when the print mode is restarted after the heating of the ink is stopped as the print mode is stopped is assumed.

So, the printing apparatus may be configured so that the control unit selectively performs a heating stop mode of causing the ink feeding unit to perform the low-speed circulation while causing the heating unit to heat the ink and a non-heating stop mode of causing the ink feeding unit to perform the low-speed circulation without causing the heating unit to heat the ink when the print mode is stopped. In such a configuration, for example, the print mode can be quickly restarted by selecting the heating stop mode when the print mode is stopped if a time to the next print mode is expected to be short, whereas the drying/solidification of the ink can be suppressed by selecting the non-heating stop mode when the print mode is stopped if a time to the next print mode is expected to be long.

The printing apparatus may further comprises a first operating unit which receives an end instruction by a user, wherein, the control unit performs the heating stop mode while the first operating unit does not receive the end instruction and performs the non-heating stop mode if the first operating unit receives the end instruction when the print mode is stopped. In such a configuration, if there is no end instruction from the user, the heating stop mode is performed when the print mode is stopped. Thus, the print mode can be quickly restarted. On the other hand, if there is an end instruction from the user, the non-heating stop mode is performed when the print mode is stopped. Thus, the drying/solidification of the ink can be suppressed. Accordingly, the user may select the heating stop mode if a time to the restart of the print mode is expected to be short and may select the non-heating stop mode if a time to the restart of the print mode is expected to be long. Therefore, the ink can be properly heated according to the user's situation judgment.

The printing apparatus may further comprises a cap which performs capping to cover the nozzle of the discharge head, wherein, the control unit does not cause the cap to perform the capping when the print mode is performed and causes the cap to perform the capping when the non-heating stop mode is performed. In such a configuration, the nozzle of the discharge head is covered by the cap at the time of the non-heating stop mode, wherefore the drying/solidification of the nozzle can be more effectively suppressed.

The printing apparatus may further comprises a second operating unit which receives a capping instruction instructing the execution of the capping when the heating stop mode is performed, wherein, the control unit causes the cap to perform the capping when the heating stop mode is performed if the second operating unit receives the capping instruction and does not cause the cap to perform the capping when the heating stop mode is performed if the second operating unit does not receive the capping instruction. In such a configuration, the user can suppress the drying/solidification of the ink during the heating stop mode by giving a capping instruction to the second operating unit, whereas the print mode can be quickly restarted by eliminating a time required to release the capping by not giving the capping instruction. Thus, the capping can be properly performed according to the user's situation judgment.

The printing apparatus may further comprises a third operating unit that receives a start instruction by a user, wherein, the control unit performs a start-up mode of causing the ink feeding unit to perform the normal circulation and causing heating unit to heat the ink with causing the cap to perform the capping during a period until the start of the print mode associated with the start instruction if the third operating unit receives the start instruction. In such a configuration, since the capping is performed during the period until the start of the print mode, the start of the print mode can be waited while the drying/solidification of the ink is suppressed.

Although the invention has been described with reference to specific embodiments, this description is not meant to be construed in a limiting sense. Various modifications of the disclosed embodiment, as well as other embodiments of the present invention, will become apparent to persons skilled in the art upon reference to the description of the invention. It is therefore contemplated that the appended claims will cover any such modifications or embodiments as fall within the true scope of the invention.

What is claimed is:

1. A printing apparatus, comprising:

a discharge head which discharges an ink from a nozzle;

a feed reservoir which stores the ink:

a return reservoir which stores the ink:

an ink feeding unit which selectively performs normal circulation of supplying the ink to the discharge head by circulating the ink along a circulation channel starting from the discharge head and returning to the discharge head and low-speed circulation of circulating the ink along the circulation channel at a flow rate lower than that in the normal circulation, the circulation channel being a channel in which the ink returns from the return reservoir to the feed reservoir after the ink reaches the return reservoir from the feed reservoir by way of the discharge head; and a control unit which performs a print mode of printing an image by causing the discharge head to discharge the ink from the nozzle while causing the ink feeding unit to perform the normal circulation and causes the ink feeding unit to perform the low-speed circulation when the print mode is stopped, wherein the control unit controls the ink feeding unit so that the ink feeding unit generates (1) a first negative pressure difference between the feed reservoir and the return reservoir to perform the normal circulation and (2) a second negative pressure difference smaller than the first negative pressure difference between the feed reservoir and the return reservoir to perform the low-speed circulation.

2. The printing apparatus according to claim 1, comprising a heating unit which heats the ink, wherein, the control unit causes the heating unit to heat the ink when the print mode is performed.

3. The printing apparatus according to claim 2, wherein the control unit selectively performs a heating stop mode of causing the ink feeding unit to perform the low-speed circulation while causing the heating unit to heat the ink and a non-heating stop mode of causing the ink feeding unit to perform the low-speed circulation without causing the heating unit to heat the ink when the print mode is stopped.

4. The printing apparatus according to claim 3, further comprising a first operating unit which receives an end instruction by a user, wherein, the control unit performs the heating stop mode while the first operating unit does not receive the end instruction and performs the non-heating stop mode if the first operating unit receives the end instruction when the print mode is stopped.

5. The printing apparatus according to claim 3, further comprising a cap which performs capping to cover the nozzle of the discharge head, wherein, the control unit does not cause the cap to perform the capping when the print mode is performed and causes the cap to perform the capping when the non-heating stop mode is performed.

6. The printing apparatus according to claim 5, further comprising a second operating unit which receives a capping instruction instructing the execution of the capping when the heating stop mode is performed, wherein, the control unit causes the cap to perform the capping when the heating stop mode is performed if the second operating unit receives the capping instruction and does not cause the cap to perform the capping when the heating stop mode is performed if the second operating unit does not receive the capping instruction.

7. The printing apparatus according to claim 5, further comprising a third operating unit that receives a start instruction by a user, wherein, the control unit performs a start-up mode of causing the ink feeding unit to perform the normal circulation and causing heating unit to heat the ink with causing the cap to perform the capping during a period until the start of the print mode associated with the start instruction if the third operating unit receives the start instruction.

8. An ink circulation method, comprising:

performing a print mode of printing an image by discharging an ink from a nozzle of a discharge head while performing normal circulation of circulating the ink along a circulation channel starting from the discharge head and returning to the discharge head, the circulation channel being a channel in which the ink returns from a return reservoir to a feed reservoir after the ink reaches the return reservoir from the feed reservoir by way of the discharge head, the feed reservoir storing the ink, the return reservoir storing the ink; and performing low-speed circulation of circulating the ink along the circulation channel at a flow rate lower than that in the normal circulation when the print mode is stopped, wherein (1) a first negative pressure difference is generated between the feed reservoir and the return reservoir to perform the normal circulation and (2) a second negative pressure difference smaller than the first negative pressure difference is generated between the feed reservoir and the return reservoir to perform the low-speed circulation.

* * * * *